United States Patent [19]

Perfect

[11] 4,331,475

[45] May 25, 1982

[54] PROCESS FOR ALUMINOTHERMIC PRODUCTION OF CHROMIUM AND CHROMIUM ALLOYS LOW IN NITROGEN

[75] Inventor: Frederick H. Perfect, Wyomissing, Pa.

[73] Assignee: Reading Alloys, Inc., Robesonia, Pa.; a part interest

[21] Appl. No.: 172,545

[22] Filed: Jul. 28, 1980

[51] Int. Cl.[3] ..... C21B 15/02

[52] U.S. Cl. ..... 420/428; 75/27

[58] Field of Search ..... 75/84, 27, 176, 171, 75/135

[56] References Cited

U.S. PATENT DOCUMENTS

| | | | |
|---|---|---|---|
| 2,242,759 | 5/1941 | Schlecht et al. | 75/84 |
| 2,789,896 | 4/1957 | Coffer | 75/84 |
| 4,169,722 | 10/1979 | Fletcher | 75/27 |

*Primary Examiner*—M. J. Andrews

*Attorney, Agent, or Firm*—Steele, Gould & Fried

[57] ABSTRACT

A process is provided for the aluminothermic production of low nitrogen containing chromium and chromium alloys, said chromium alloys comprising about 80% chromium, about 20% nickel and less than 0.005% nitrogen, said alloys being especially desirable for use as master alloys in production of super alloys where levels of nitrogen imparted by chromium alloying elements are critical.

6 Claims, No Drawings

PROCESS FOR ALUMINOTHERMIC PRODUCTION OF CHROMIUM AND CHROMIUM ALLOYS LOW IN NITROGEN

BACKGROUND OF THE INVENTION

Chromium and chromium master alloys are widely used in production of "super" alloys. Some manufacturers of such super alloys desire extremely low limits of nitrogen in the master alloys in order that the ultimate alloy not have unacceptable impurities and inclusions resulting from nitrogen. For example, one super alloy manufacturer specifies that chromium master alloys have a maximum of 0.003%, by weight, nitrogen. Such products were unknown in the commercial marketplace prior to the present invention with typical commercially available chromium containing as low as only 0.008 to about 0.03% nitrogen. It was recognized in the art that this rather high nitrogen content occurred as the result of reaction of chromium with the atmosphere (air), during production.

There may have been attempts to produce low nitrogen chromium and chromium master alloys by refining under vacuum conditions to reduce the nitrogen content of the chromium or chromium alloys; however, such attempts are not known to have been successful or practical means of reducing the nitrogen content of the chromium or chromium master alloys to acceptable levels.

A water cooled copper vessel has found wide use for production of high purity master alloys by the thermite process. A form of water cooled copper vessel is described by applicant in Trans. Met. Soc. AIME 1967, Vol. 239, pp. 1282–1286. It is practical to remove nitrogen from a thermite system to be reduced in such a vessel since the vessel can be made vacuum tight. If this process were followed in the aluminothermic reduction of chromium oxides, it should preclude high nitrogen content in the resultant product by eliminating pick up of nitrogen from the atmosphere during the reduction, cooling and solidification periods.

However, the water cooled copper walls of such vessels generally limit their usefulness to reduction of those metals or alloys melting at about 1650° C. or lower. Chromium metal melts at about 1880° C., and was found to splash about the copper vessel during reduction. This caused a thin layer of chromium to coat the walls of the vessel above the reduction zone. This thin layer of metal is commonly referred to as an armour plate.

It is the object of this invention to produce chromium-nickel master alloys having a nitrogen content of less than 0.005%, preferably as low as 0.001% to 0.003%, by weight. It is a further object of this invention to produce such master alloys in water cooled copper vessels after vacuum degassing the mix and subsequent reaction (reduction) under an inert gas atmosphere.

DETAILED DESCRIPTION OF THE INVENTION

According to this invention there is provided a process for the production of chromium-nickel alloys low in nitrogen comprising vacuum degassing a thermite mixture of chromium oxide and nickel and reducing the thermite mixture of chromium oxide and nickel in an atmosphere inert to the reactants and resultant master alloy thereby producing an alloy comprising about 80% chromium, about 20% nickel and less than 0.005% nitrogen, said percentages being by weight based on the weight of the alloy.

The process of the invention includes aluminothermic reduction of oxides of chromium and nickel to produce a master alloy containing less than 0.005% nitrogen. In carrying out the process, the respective amounts of chromium oxide and nickel are proportioned so as to provide a chromium nickel alloy containing about 80% chromium, about 20% nickel and less than 0.005% nitrogen.

Preferably, the alloy produced will contain from about 0.001% to about 0.003%, by weight, nitrogen.

The chromium-nickel master alloys are prepared by aluminothermic reduction of a chromium oxide and nickel. The amount of aluminum employed is that which is sufficient for reduction of the metal oxides in accordance with procedures well known in the art. Chromium sesquioxide is commonly used as the source of chromium.

In carrying out the process of the invention, the chromium oxide, nickel and aluminum may be reduced to relatively small size and intimately mixed so that the reaction will occur rapidly and uniformly once the charge is ignited. The chromium oxide, nickel and aluminum used in the process should be of the highest purity available commercially. It is generally necessary to use an oxidizer, such as sodium chlorate as an accelerator in order to provide temperatures high enough for good fusion and separation of the metal and slag. A flux is also typically used in the reaction.

The aluminothermic reduction is carried out by placing the thermite mixture in a water cooled copper reaction vessel, covering the vessel, and reducing the pressure within the charged vessel to about 0.3 mm Hg. or less. This vacuum degassing removes air, the essential source of nitrogen in chromiun and chromium master alloys. After reducing the pressure to this level, the vessel is flooded with high purity inert gas, preferably argon, and sufficient time is permitted for the argon to permeate throughout the thermite mixture. Generally a period of about five minutes is required for thorough soaking of this mix by the inert gas. At this time the thermite mixture is ignited, and the reduction process is completed almost instantly. The process results in formation of a chromium nickel master alloy having less than 0.005% nitrogen. This is most important since there is ample evidence that it is almost impossible to remove nitrogen once it is present in chromium metal, even with resort to techniques such as electron beam melting to remove the undesired impurity. It is thought that the remaining nitrogen may be nitrogen combined with the aluminum powder and chromium oxide reactants which is not removed by the vacuum degassing.

The process of the invention may be more completely described by the following examples:

EXAMPLE 1

The materials shown in Table I were combined and mixed together:

TABLE I

| Ingredient | Weight (lbs.) |
|---|---|
| Aluminum | 60.0 |
| Calcium oxide | 48.0 |
| Calcium fluoride | 10.0 |
| Chromium sesquioxide | 140.0 |
| Sodium chlorate | 20.0 |

TABLE I-continued

| Ingredient | Weight (lbs.) |
|---|---|
| Nickel | 20.0 |

After mixing, the charge was placed in a water cooled copper furnace which had been previously evacuated and filled with argon. The copper furnace was then pumped down to less than 0.15 to 0.2 mm Hg. in a few minutes with the aid of two mechanical pumps each having a pumping capacity of 35,000 liters/minute at 0.5 mm Hg. The furnace was then flooded with high purity argon with ample time (at least five minutes) allowed for the argon to soak thoroughly into the mix. At this point, the lid of the copper furnace was removed quickly, a hot top was installed, and a smoke scrubber was moved over the furnace, and the mixture was ignited. In less than a minute the reaction was complete. The molten slag produced in the reaction protects the metal from the atmosphere (and any pick up of nitrogen from the atmosphere) while the alloy is cooling. An ingot weighing 108.0 pounds was produced.

The analysis of the alloy produced is in Table II.

TABLE II

| | Percent |
|---|---|
| Al | 0.080 |
| C | 0.045 |
| Cr | 80.49 |
| Fe | 0.57 |
| Ni | 18.22 |
| $N_2$ | 0.0028 |
| $O_2$ | 0.061 |
| P | 0.007 |
| Si | 0.030 |
| S | 0.010 |

EXAMPLE 2

Following the procedure of Example 1, an alloy was prepared from the mixture shown in Table III.

TABLE III

| Ingredient | Weight (lbs). |
|---|---|
| Aluminum | 60.0 |
| Calcium oxide | 48.0 |
| Calcium fluoride | 10.0 |
| Chromium sesquioxide | 140.0 |
| Sodium chlorate | 20.0 |
| Nickel | 20.0 |

The mixture was ignited and run for about one minute; the ingot produced weighing about 105 lbs. The resulting alloy analysis is shown in Table IV.

TABLE IV

| | |
|---|---|
| Al | 0.59 |
| C | — |
| Cr | 79.89 |
| Fe | 0.37 |
| Ni | 18.44 |
| $N_2$ | 0.0023 |
| $O_2$ | 0.062 |
| P | 0.005 |
| Si | 0.096 |
| S | 0.016 |

EXAMPLE 3

Following the procedure of Example 1, an alloy was prepared from the mixture shown in Table V.

TABLE V

| Ingredient | Weight (lbs). |
|---|---|
| Aluminum | 60.0 |
| Calcium oxide | 48.0 |
| Calcium fluoride | 5.0 |
| Chromium sesquioxide | 140.0 |
| Sodium chlorate | 20.0 |
| Nickel | 20.0 |

The mixture was ignited and run for about one minute, the ingot produced weighed about 106 lbs. The resulting alloy analysis is shown in Table VI.

TABLE VI

| | Percent |
|---|---|
| Al | 0.052 |
| C | 0.040 |
| Cr | 79.62 |
| Fe | 0.58 |
| Ni | 19.05 |
| $N_2$ | 0.0023 |
| $O_2$ | 0.163 |
| P | 0.004 |
| Si | 0.051 |
| S | 0.014 |

EXAMPLE 4

Following the procedure of Example 1, a 30,000 pound production lot of alloy was prepared from the mixture shown in Table VII.

TABLE VII

| Ingredient | Weight (lbs.) |
|---|---|
| Aluminum (−200 mesh) | 57.0 |
| Flux (40-30-30 of Foote Mineral Co.) | 15.0 |
| Chromium sesquioxide (−200 mesh) | 140.0 |
| Sodium chlorate | 16.0 |
| Nickel (−20 mesh) | 20.0 |

The mixture was ignited and run for about one minute and the ingots produced weighed an average of 105.56 lbs. The resulting alloy analysis is shown in Table XIII.

TABLE VIII

| | Percent |
|---|---|
| Al | 0.82 |
| C | 0.02 |
| Cr | 79.83 |
| Fe | 0.22 |
| Ni | 18.84 |
| $N_2$ | 0.0018 |
| $O_2$ | 0.090 |
| P | 0.006 |
| Si | 0.10 |
| S | 0.006 |

EXAMPLE 5

For comparison, an alloy was prepared from the mixture shown in Table IX, and following the process of Example 1 except that the reduction was completed in air.

TABLE IX

| Ingredient | Weight (lbs.) |
|---|---|
| Aluminum | 60.0 |
| Calcium oxide | 48.0 |
| Calcium fluoride | 10.0 |

TABLE IX-continued

| Ingredient | Weight (lbs.) |
|---|---|
| Chromium sesquioxide | 140.0 |
| Sodium chlorate | 20.0 |
| Nickel | 20.0 |

The mixture was ignited and run for about one minute; the ingot produced weighed about 105 lbs. The resulting alloy analysis is shown in Table X.

TABLE X

| | Percent |
|---|---|
| Al | 0.18 |
| C | 0.043 |
| Cr | 80.66 |
| Fe | 0.29 |
| Ni | 18.10 |
| $N_2$ | 0.02 |
| $O_2$ | 0.069 |
| P | 0.003 |
| Si | 0.044 |
| S | 0.0085 |

Having thus described the invention,
What is claimed is:

1. A process for the production of chromium-nickel alloys low in nitrogen comprising vacuum degassing a thermite mixture of chromium oxide and nickel and reducing the thermite mixture of chromium oxide and nickel in an atmosphere inert to the reactants and resulting master alloy, producing an alloy comprising about 80% chromium, about 20% nickel and less than 0.005% nitrogen, said percentages being by weight, based on the weight of the alloy.

2. The process of claim 1 wherein aluminum is the reducing agent.

3. The process of claim 2 wherein said aluminothermic reduction occurs in a water cooled copper vessel.

4. The process of claim 3 wherein said inert atmosphere is obtained by evacuating the reaction vessel to about 0.3 mm Hg. or less and flooding the reaction mixture with an atmosphere of an inert gas and maintaining the inert gas atmosphere throughout the aluminothermic reduction.

5. The process of claim 4 wherein said inert gas is argon.

6. The process of claim 1 wherein said chromium-nickel alloys contain from about 0.001% to about 0.003%, by weight, nitrogen.

* * * * *